US006881082B2

(12) United States Patent
Jordan et al.

(10) Patent No.: US 6,881,082 B2
(45) Date of Patent: Apr. 19, 2005

(54) CONNECTION-SWITCH ARRANGEMENT

(75) Inventors: Peter Jordan, Basingstoke (GB); Ian James Stafford Gray, Winchester (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/615,999

(22) Filed: Jul. 9, 2003

(65) Prior Publication Data

US 2005/0009391 A1 Jan. 13, 2005

(30) Foreign Application Priority Data

Jul. 11, 2002 (GB) ..... 0216111

(51) Int. Cl.[7] ..... H01R 29/00
(52) U.S. Cl. ..... 439/188; 439/63; 439/944
(58) Field of Search ..... 439/188, 944, 439/63, 581; 200/51.1

(56) References Cited

U.S. PATENT DOCUMENTS 6,030,240 A * 2/2000 Duff ..... 439/188
6,068,499 A 5/2000 Kuriyama et al.
6,146,168 A * 11/2000 Ishii ..... 439/188
6,224,407 B1 * 5/2001 Duquerroy et al. ..... 439/188
6,439,906 B1 * 8/2002 Gray et al. ..... 439/188
6,554,630 B1 * 4/2003 Uratani ..... 439/188
2001/0005645 A1 6/2001 Zech et al.
2004/0002245 A1 * 1/2004 McDaid et al. ..... 439/188

FOREIGN PATENT DOCUMENTS

EP 1115183 A1 1/2001
GB 2307113 A 5/1997
GB 2336480 A 10/1999

* cited by examiner

*Primary Examiner*—Tho D. Ta
(74) *Attorney, Agent, or Firm*—Roger C. Turner

(57) ABSTRACT

A connection arrangement includes a first connector (12) with an opening leading to first and second contacts (14, 16), where the first contact includes a beam (40) that is biased upwardly against the second contact but which can be depressed out of engagement with the second contact. The beam is depressed by a plug inner contact (32) of a mating second connector (30) that passes into the opening and depresses the beam, in an arrangement that assures firm engagement of the plug inner contact with the beam despite small beam movement. A stop (70) lying under the beam, limits its downward movement by the plug inner contact. The plug inner contact is spring biased downwardly with respect to the second connector frame (36) but can move up, so the second connector can continue to move down a short distance after the plug inner contact has pushed the beam against the stop, to enable-full engagement of largely coaxial outer contacts (26, 34) of the first and second connectors. The arrangement enables reduced downward movement of the beam while assuring considerable pressure contact between the plug inner contact and beam.

14 Claims, 3 Drawing Sheets

PRIOR
ART

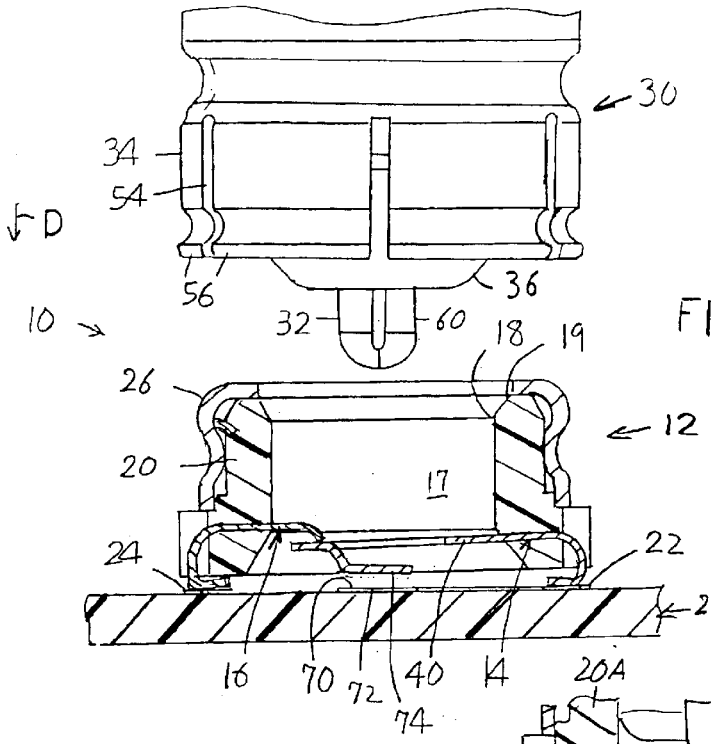
FIG. 2
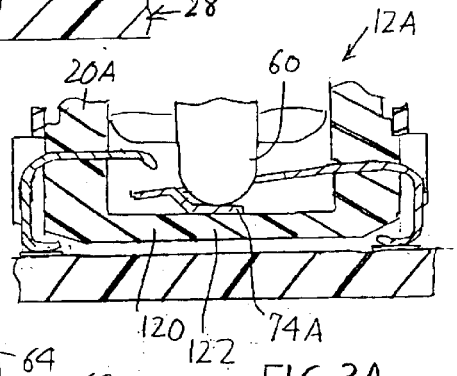
FIG. 3A
FIG. 3
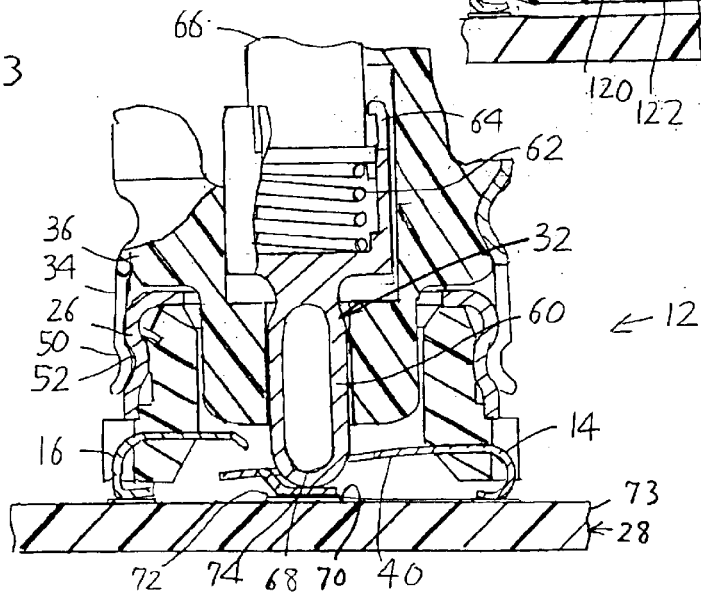

CONNECTION-SWITCH ARRANGEMENT

CROSS-REFERENCE

Applicant claims priority from United Kingdom patent application GB 0216111.5 filed Jul. 11, 2002.

BACKGROUND OF THE INVENTION

U.S. Pat. No. 6,439,906 describes a coaxial connector system in which a first connector has a first contact with a beam that is upwardly biased against a second contact. When a second connector, or plug, is pushed toward the first connector, a plug inner contact pushes down the beam and deflects it out of engagement with the second contact. This arrangement not only opens one circuit, between the first and second contacts, and closes another circuit, between the first contact and the plug inner contact, but enables the plug to be pushed down sufficiently for outer coaxial contacts to fully engage one another. One disadvantage of this arrangement is that there is only moderate pressure between the inner contact of a plug and the beam, which can result in high resistance between them. Also, to obtain even moderate force between the plug inner contact and the beam, the beam should be deflected considerably, which can require a longer beam or which can result in excessive stress on the beam. A connection system that minimized stress of the beam while ensuring firm engagement of the beam and plug inner contact, would be of value.

The connection system is especially useful for a mobile phone system, in which a mobile phone has a transmit/receive circuit that is initially connected to a portable antenna on the mobile phone. When the mobile phone is placed against a docking station which recharges batteries in the mobile phone, the transmit/receive circuit is disconnected from the portable antenna, and connected to a more effective stationary antenna on the docking station. The disconnection from the portable antenna and connection to the stationary antenna, is done automatically during docking. Coaxial connectors are used to transmit high frequency signals to the docking station antenna. Other applications can require such a connector system.

SUMMARY OF THE INVENTION

In accordance with one embodiment of the present invention, a connection/switch arrangement is provided, in which a first connector in the form of a receptacle has an opening that can receive a second connector, or actuator, in the form of a plug. When the plug is received, an inner contact of the plug contacts and downwardly deflects a beam until the plug is fully installed in the receptacle. The present system minimizes deflection of the beam and assures high pressure contact between the plug inner contact and beam. A stop lying under the beam, limits downward deflection of the beam, which assures high contact pressure with small beam deflection. The plug inner contact can slide upward with respect to the plug frame against the resilience of a spring. Accordingly, when the plug is pushed down, the plug inner contact depresses the beam against the stop, and the plug frame can continue to move down slightly while the plug inner contact is stopped.

The receptacle connector is mounted on a circuit board. The stop can be formed by the circuit board.

The novel features of the invention are set forth with particularity in the appended claims. The invention will be best understood from the following description when read in conjunction with the accompanying drawings.

BRIEF DESCRIPTION OF THE DRAWINGS

FIG. 2 is an exploded view of a connector/switch arrangement of the present invention, with the receptacle, or first connector shown in section view and shown mounted on a circuit board.

FIG. 3 is a sectional view of the connector/switch arrangement of FIG. 2, with the connectors fully engaged with each other.

FIG. 3A is a partial sectional view of a connector/switch arrangement of another embodiment of the invention.

DESCRIPTION OF THE PREFERRED EMBODIMENTS

Figure 1:
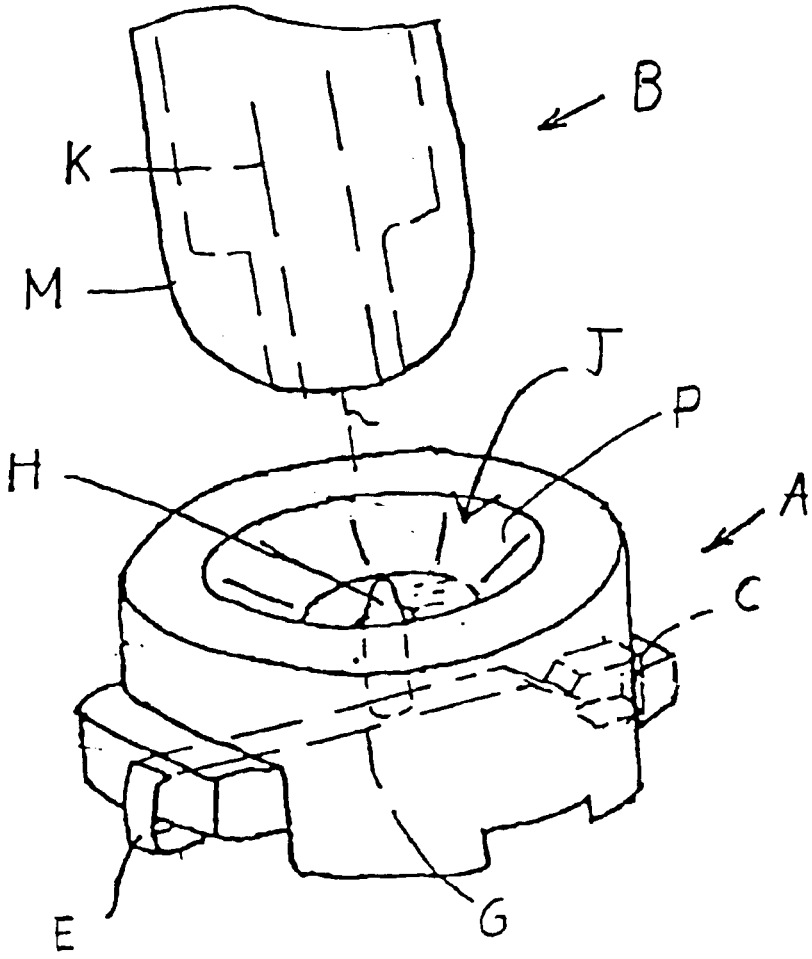
FIG. 1 is an exploded isometric view of a connector/switch assembly of the prior art.

FIG. 1 shows a prior art connector assembly, which includes a first connector/switch or receptacle A, which is usually mounted on a circuit board, and a second connector or plug B. The receptacle has first and second contacts C, E, with the first contact having a beam G that is normally engaged with the second contact E. A projection H projects upwardly from a location on the beam G. When the plug B is pushed down into an entrance J of the receptacle, an inner contact K of the plug engages the upward projection H on the beam, and downwardly deflects the projection and beam. Such downward deflection continues until an outer contact M of the plug engages an outer contact P of the receptacle. It is difficult to assure high pressure contact between the plug inner contact K and projection H.

FIG. 2 illustrates a connection arrangement 10 of the present invention, which includes a first connector 12 that also operates as a switch and which can be referred to as a receptacle, that is mounted on a circuit board 14. The particular receptacle 12 has first and second contacts 14, 16 mounted on an insulative housing 20. The housing has an entrance or opening 18 in its top 19, the opening leading to a cavity 17 that receives the first and second contacts. The contacts have tails connected to conductive traces 22, 24 on the upper face of the circuit board 28, as by solder connections. The receptacle has an outer contact 26 which is also mounted on the insulative housing, and which is connected to a circuit trace that is grounded.

A second or plug connector, or actuator 30, is designed to mate with the receptacle 12 by moving down the plug 30, in the direction D when the receptacle is in the orientation shown. The plug includes inner and outer plug contacts 32, 34 mounted on an insulative plug frame 36. The particular plug is a coaxial plug, in which case the plug inner contact lies within the outer contact, but the plug inner contact is not necessarily a coax inner contact. The receptacle outer contact 26 is not truly a coax contact.

The first contact 14 of the receptacle includes a beam 40 that is biased upwardly against the second contact 16. In a mobile phone, the first contact 14 may be connected to a transmit/receive circuit on the mobile phone, while the second contact 24 is connected to a portable antenna on the mobile phone. When the plug 30 is pushed downward against the receptacle, the plug inner contact 32 engages and downwardly deflects the beam 40, so the beam 40 moves out of engagement with the first contact 16. At the same time, the plug inner contact 32 has made engagement with the beam 40 so they are electrically connected. In the above example, the plug 30 is part of a docking station for a mobile phone, and the plug inner contact 32 is connected to a docking station antenna which provides better reception and transmission than the portable antenna on the local phone. When the plug contact 32 engages the deflectable beam 40, the transmit/receive circuit that is connected to the first contact 14 is connected to the docking station antenna, and is disconnected from the second contact 16 that leads to the mobile antenna.

FIG. 3 shows the plug and receptacle in a fully mated position. The plug inner contact 32 has downwardly deflected the beam 40 of the first contact 14, so the first contact 14 is out of engagement with the second contact 16, and the first contact 14 is engaged with the plug inner contact 32. At the same time, the plug outer contact 34 has engaged the receptacle outer contact 26. In the particular connector illustrated, the plug outer contact 34 has a resiliently-deflectable projection 50 that enters a fixed groove 52 in the receptacle outer contact, to not only cause the outer contacts to engage each other, but to latch the connectors together and provide a "click" for tactile feedback. As shown in FIG. 2, the plug outer contact has slots 54 that divide a sheet metal plug outer contact into a plurality of tines 56 that can be resiliently deflected apart and then resiliently press inwardly.

In order to assure that the plug 30 can be pressed down far enough for the plug outer contact projection 50 to fully enter the receptacle outer contact groove 52, the plug inner contact 32 is able to accommodate different heights of the plug frame 36 and plug outer contact 34. Previously, this was accomplished by relying solely on deflection of the receptacle first contact beam 40 by varying amounts. The present invention does not require varying amounts of beam deflection.

The plug inner contact 32 is moveably mounted in the plug frame so a lower part 60 of the plug inner contact can move upwardly with respect to the plug frame 36. This is accomplished by mounting the lower part 60 of the plug inner contact so it is vertically slideable and is biased downwardly by a spring 62. In FIG. 3, the lower part 60 has tines 64 that engage an upper part 66 of the plug inner contact. It is also possible to carry current through the spring, although this can add inductance, and is usually not desirable for high frequencies.

Applicant uses an area 70 of the circuit board as a stop that limits downward movement of the beam 40. The stop 70 ensures firm engagement of a tip 68 of the contact lower part 60 with the beam, despite only a small downward movement of the beam. This allows the use of a thinner and more resilient sheet metal beam and enables the use of a receptacle of smaller height. In addition, this arrangement assures firm contact of the plug inner contact part with the beam, with the force being controlled primarily by the pre-load of the spring 62.

Applicant prefers to provide the circuit board with a conductive trace 72 on the circuit board substrate 72, the trace lying under an engaging part of the beam 74. The trace 72 is connected to trace 22. This allows currents to flow directly between the plug inner contact and a circuit board trace that connects to the receive/transmit circuit, to flow directly through the engaging part of the beam 74, instead of through the curved rest of the first contact, to minimize inductance.

Figure 4:
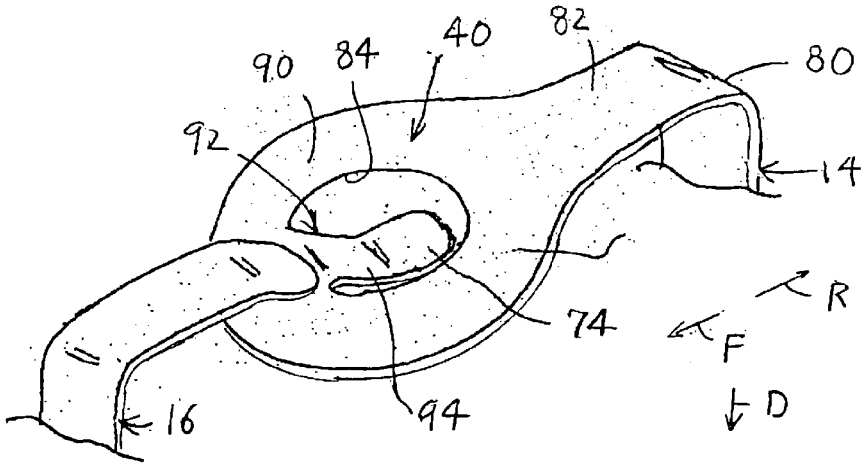
FIG. 4 is a partial isometric view of the first and second contacts of the connector/switch arrangement of FIGS. 2 and 3.

FIG. 4 shows some details of the first and second contacts 14, 16. Both contacts are formed of sheet metal, with the first contact forming a bend at 80, an overmolded mounted part at 82 that is molded to the receptacle housing, and the beam 40. The beam extends forwardly F from the mounted part. The beam includes a wide forward part 90 with a hole 84 forming a tongue 92. The tongue 92 has a part 94 that extends rearwardly R and downward D, and that forms the engaging part 74. The tongue inclined part 94 locates the engaging part 74 under the wide part 90 near the front of the beam.

Figure 5:
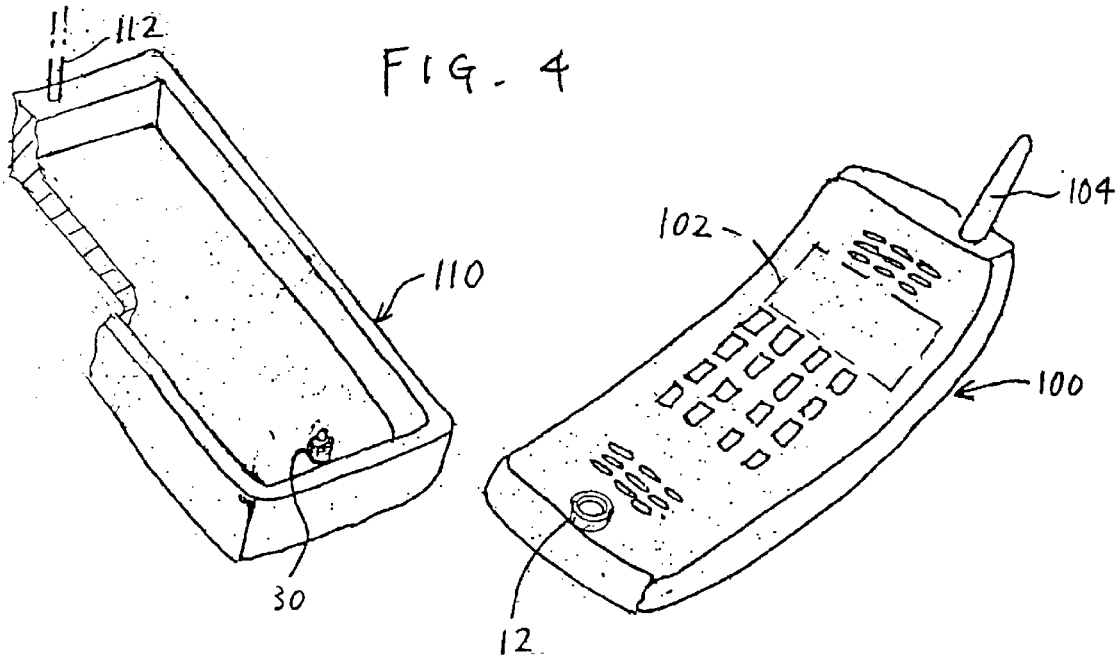
FIG. 5 is an exploded isometric view of a mobile phone and a portion of a docking station, which includes the connection/switching system of FIGS. 2, 3 and 4.

FIG. 5 shows a transceiver in the form of a mobile phone 100 with a transmit/receive circuit 102 that is normally connected to a portable mobile phone antenna 104. The receptacle 12 lies in the mobile phone. A docking station 110 which can receive the mobile phone, forms the plug 30 that connects to the receptacle 12 when the mobile phone is placed on the docking station. A docking station antenna 112 which is more efficient than the mobile phone antenna 104 is connected to the circuit 102 when the mobile phone is docked.

FIG. 3A illustrates another arrangement, in which the housing 20A of a connector 12A forms a lower wall 120 that forms a stop 122 that stops downward deflection of the beam part 74A.

While applicant has used terms such as "down" and "up" to describe operation of the apparatus as illustrated in the drawings, it should be understood that the connectors can be used in any orientation with respect to the Earth.

Thus, the invention provides a connector/switch system, or connection arrangement, which is especially useful for connecting coaxial connectors and switching a first contact of the receptacle connector out of engagement with a second contact of the receptacle when an inner contact of a plug engages the first contact of the receptacle. The first contact includes a downwardly-deflectable beam which is preferably integral with the rest of the first contact and which is downwardly deflected by the plug inner contact of the receptacle. A stop is provided which stops downward movement of the beam after it has deflected downward by a small distance out of engagement with the second contact. The plug inner contact includes a downwardly-biased slideable part that allows a frame of the plug to move down slightly further after the plug inner contact part has been stopped from further downward movement when it presses the beam against the stop. The stop can be formed by a circuit board on which the receptacle is mounted.

The novel features of the invention are set forth with particularity in the appended claims. The invention will be best understood from the following description when read in conjunction with the accompanying drawings.

What is claimed is:

1. A connection arrangement for mounting on a circuit board, which includes a first connector having a housing with an opening leading to a cavity, said first connector having a contact arrangement that includes first and second contacts each mounted on said housing and each being connectable to the circuit board, said first contact including a moveable beam lying in said cavity and biased upward toward an initial position in which said beam engages said second contact, said connection arrangement including a plug with a frame and a plug contact part that can be moved down through said opening to engage said beam and downwardly deflect said beam out of engagement with said second contact, including:

walls forming a stop lying under the beam for limiting its downward movement; and wherein said plug contact part is moveable primarily upward and downward in said frame, and said plug includes a spring that urges said plug contact pad to move downwardly relative to said frame; wherein:

said beam comprises a first substantially flat beam portion, a second beam portion extending largely downwardly towards the circuit board from the first beam portion, and a third beam portion extending largely horizontally from a bottom of said second beam portion, and said plug contact pad is positioned to push down said third beam portion against the stop.

2. The connection arrangement described in claim 1 wherein:

said first connector has an outer contact, and said plug has a plug outer contact, said first connector and plug are moveable together to a fully mated position at which said outer contacts are engaged;

in said fully mated position, said plug contact part presses said beam against said stop.

3. The connection arrangement described in claim 1, wherein:

when the first connector is mounted on a printed circuit board, the stop is formed by an area of the circuit board.

4. The connection arrangement described in claim 1, including:

a portable transceiver having a transmit/receive circuit and a portable antenna;

a docking station with a docking station antenna;

said first connector mounted on said portable transceiver and said plug mounted on said docking station;

said antennas are connectable to said first and second contacts to disconnect the portable antenna from the transmit/receive circuit and connect the docking station antenna to the transmit/receive circuit when the portable transceiver is docked to said docking station.

5. A connection arrangement that includes a circuit board with conductive traces and a connector mounted on the board, wherein:

said connector includes a housing with a cavity and an opening leading to said cavity;

first and second contacts each mounted on said housing and connected to one of said traces on the board, said first contact including a moveable beam lying in said cavity and biased against said second contact but deflectable downward out of engagement with said second contact;

stop means lying directly under said beam for stopping downward movement of said beam; wherein:

said first contact has a mounted pad mounted on said housing and a beam that extends forwardly from said mounted pad, said beam having a beam front portion with a tongue extending back toward said mounted part and downward toward said circuit board, from the beam front portion, wherein the movement of the beam is limited by the distance between a lower end of the tongue and the stop means.

6. The connection arrangement described in claim 5, wherein:

said stop means comprises an area of said circuit board.

7. A connector system comprising a receptacle and a plug for mating with the receptacle, wherein the receptacle includes a housing forming a cavity with an opening for receiving at least a portion of said plug, a receptacle first inner contact mounted on said housing, and a receptacle outer contact mounted on said housing, wherein:

said plug includes coaxial inner and outer plug contacts for engaging said receptacle first inner contact and outer contact, respectively;

said plug inner contact is resiliently biased downward and is deflectable upward with respect to said plug outer contact;

a stop that lies under said receptacle first inner contact, whereby after said plug inner contact presses down said receptacle first inner contact against said stop said plug outer contact can continue to move down until it lies in firm engagement with said receptacle outer contact; wherein:

said receptacle is mounted on said circuit board;

said circuit board has an upper face with a trace forming said stop;

said receptacle first inner contact includes a deflectable beam that is downwardly deflectable against said trace forming said stop.

8. The system described in claim 7 including a circuit board, said receptacle being mounted on said circuit board, and wherein:

said receptacle includes a receptacle second inner contact, said receptacle first inner contact including a beam that is biased upward to lie a distance above said stop and against said receptacle second inner contact, said beam being downwardly deflectable out of engagement with said receptacle second inner contact and against said stop;

said current board has an upper face lying directly under said beam and forming said stop.

9. A connector system comprising a circuit board, a receptacle and a plug for mating with the receptacle, wherein the receptacle includes a housing mounted on the circuit board and forming a cavity with an entrance for receiving said plug, first and second receptacle contacts mounted on said housing, said first contact including a resilient beam biased upward into engagement with said second contact but being resiliently deflectable downwardly by said plug out of engagement with said second contact, wherein:

said circuit board has an area lying directly under a pad of said beam, so said beam engages said circuit board area when said beam is downwardly deflected by said plug; wherein:

said plug includes a plug outer portion that can be pressed toward said housing only to a predetermined position said plug has a plug housing and said plug has an inner contact with a tip, said inner contact being slideable up and down in said plug housing, and said plug has a spring that urges said tip downward beyond said housing, said plug inner contact being slideable sufficiently that said tip presses said beam against said circuit board area when said plug outer portion lies in said predetermined position.

10. A connection system that includes a circuit board with a conductive trace, a plug and a receptacle that has an opening that receives a portion of the plug, wherein:

said plug includes a plug housing, a plug inner contact with a tip, said plug housing having a largely vertically extending passage said plug inner contact being slideable in said passage, and a spring that urges said plug inner contact to slide downward, said tip lying below and outside of said passage when not deflected upwardly; wherein:

said receptacle has a first contact with a deflectable portion that is engaged by said tip of said plug inner contact with said deflectable portion deflected against said conductive trace.

11. The connection system described in claim 10 wherein:

said plug is a coaxial plug with a plug outer contact lying on said plug housing around said plug inner contact.

12. The connector described in claim 10 wherein:

said receptacle includes a receptacle housing and inner and outer receptacle contacts mounted on said receptacle housing, said outer receptacle contact positioned to engage said plug outer contact while said plug inner contact engages said receptacle inner contact.

13. A connector system comprising a receptacle and a plug for mating with the receptacle, wherein the receptacle includes a housing forming a cavity with an entrance for receiving said plug, and first and second receptacle contacts mounted on said housing, said first contact including a resilient beam biased upward into engagement with said second contact but being resiliently delectable downwardly by said plug out of engagement with said second contact, wherein:

said first contact is formed of sheet metal and has a mounted part that is fixed to said housing, and said beam has a largely flat portion extending forwardly from said mounted part, said flat portion having a front part with walls forming a hole, said walls forming a hole having a front end, and said first contact forms a tongue extending at a rearward and downward incline from said hole front end.

14. The connector system described in claim 13 wherein:

said tongue has a lower end that is substantially flat and horizontal.

* * * * *